United States Patent [19]

Torok

[11] 4,287,002

[45] Sep. 1, 1981

[54] NUCLEAR REACTOR DECONTAMINATION

[75] Inventor: John Torok, Deep River, Canada

[73] Assignee: Atomic Energy of Canada Ltd., Ottawa, Canada

[21] Appl. No.: 28,200

[22] Filed: Apr. 9, 1979

[51] Int. Cl.[3] ..... B08B 7/04

[52] U.S. Cl. ..... 134/3; 134/10; 134/13; 134/28; 134/30; 134/36; 134/41; 176/37

[58] Field of Search ..... 134/2, 3, 10, 13, 28, 134/30, 36, 41; 176/37; 252/301.1 W

[56] References Cited

U.S. PATENT DOCUMENTS

| | | | |
|---|---|---|---|
| 3,013,909 | 12/1961 | Pancer et al. | 134/3 |
| 3,664,870 | 5/1972 | Oberhofer et al. | 134/3 |
| 3,737,373 | 6/1973 | Motojima et al. | 134/3 X |
| 3,873,362 | 3/1975 | Mihram et al. | 134/3 |
| 4,042,455 | 8/1977 | Brown | 176/38 X |
| 4,162,229 | 7/1979 | Loewenschuss | 134/3 X |

FOREIGN PATENT DOCUMENTS

| | | | |
|---|---|---|---|
| 2358683 | 6/1975 | Fed. Rep. of Germany | 134/3 |

*Primary Examiner*—Marc L. Caroff
*Attorney, Agent, or Firm*—Alan A. Thomson

[57] ABSTRACT

Heat transfer and associated surfaces in nuclear reactors are decontaminated by treating the surface with ozone to oxidize acid-insoluble metal oxides to a more soluble state, removing oxidized solubilized metal oxides, and removing other surface oxides using low concentrations of decontaminating reagents. Ozone treatment has been found very effective with alloys having surface metal oxides rendered more easily dissolved by ozone oxidation especially with chromium or chromium-nickel containing alloys.

19 Claims, 2 Drawing Figures

NUCLEAR REACTOR DECONTAMINATION

FIELD OF THE INVENTION

This invention relates to the removal of radioactive material dispersed on the walls of primary heat transport surfaces of pressurized water nuclear reactors (PWRs), pressurized heavy water nuclear reactors (PHWRs) and boiling water nuclear reactors (BWRs) and any other reactors subject to radioactive metal oxide deposits.

DESCRIPTION OF THE PRIOR ART

Corrosion products of surfaces located outside the reactor, such as boiler tubes and pipes, are transported into the reactor core where they are deposited on the fuel elements. They remain in the reactor for some time where they are irradiated and become radioactive. They are then released into the primary heat transport system (PHTS) and are deposited on the boilers, piping and other outreactor parts of the system. Thus, the radioactive corrosion products give rise to radiation fields outside the reactor core and radiation dosage to personnel. The doses of radiation received must be kept within regulatory limits, and should, in fact, be kept as small as is reasonably possible.

Another source of radiation field is the occasional rupture of the metal sheath encasing the fuel. The products of nuclear fission, most of them radioactive, are leached out of the fuel elements by the circulating water. They are subsequently incorporated into the surface oxide layer of out-reactor parts of the system.

The periodic removal of activated corrosion and fission products from heat transport system surfaces is desirable, especially prior to major repairs being made to the primary heat transport system.

A substantial portion of the radioactive isotopes can be removed from the surfaces by the partial or complete dissolution of the surface oxide layer, a process herein referred to as decontamination. The art of nuclear reactor decontamination has been described in detail in J. A. Ayres, Editor, "Decontamination of Nuclear Reactors and Equipment", The Ronald Press Company, New York, (1970).

A two-stage process has been most widely used in the conventional decontamination of nuclear reactors with iron- , nickel- , and chromium-containing alloys. The first stage involved alkaline permanganate treatment. The reactor would be de-fueled, drained and then refilled with an alkaline permanganate solution containing from 10 to 18% sodium hydroxide and approximately 3% potassium permanganate ($KMnO_4$). The treatment, at 102°to 110° C., lasts for several hours. The system is drained and rinsed with water several times. Recent work, J. P. Coad and J. H. Carter, "The Application of X-ray Photoelectron Spectroscopy to Decontamination Procedures", UKAEA, Harwell, AERE-R-8768 (1977 June), indicated that the most important process in this first stage was the oxidative dissolution of chromium (III) oxide by the following process:

$$3\ MnO_4^- + Cr^{+3} \rightarrow 3\ MnO_4^{-2} + Cr^{+6}$$

In the second step the surface oxide was dissolved by organic acids and complexing agents. The variety of reagents, treatment conditions and reagent concentrations is large and has been well documented (see Ayres reference above). Typical reagent concentration utilized was 9 wt%. The second step was followed by several water rinses.

Reactor decontamination processes involving a permanganate oxidation step have been described in U.S. Pat. No. 3,013,909, December 19, 1961; 3,615,817, Oct. 26, 1971; and 3,873,362, Mar. 25, 1975. U.S. Pat. No. 4,042,455, Aug. 16, 1977 mentions oxygen (preferably $H_2O_2$) treatment in reactor decontamination without any second step using acidic decontaminating reagents. U.S. Pat. No. 3,873,362 utilizes an oxidizing pre-treatment which is followed by an oxide dissolution step utilizing acidic reagents. This patent usually specifies hydrogen peroxide as the pre-treatment reagent and an aggressive inorganic acid, sulfuric acid, as one of the second stage reagents. The pre-treatment step is linked to the nature of the scale removal step (column 1, lines 46 to 53):

> Since the preferred decontamination and scale removal solution used in the second step is a mixture of sulfuric and oxalic acids, it is preferred that the oxidizing solution used as a preconditioning material function effectively in conjunction with this specific acid solution used in the next step.

Example 10 of U.S. Pat. No. 3,873,362 illustrates that the role of the first step oxidation process is primarily to reduce the corrosion rate in the second stage. The improvement in decontamination factor due to this oxidation step is not large. The decontamination factor was 290 without and 360 with first-stage oxidation, a 24% improvement. Comparative results with this patent are given in Examples 14 and 15 below.

It takes several weeks to complete this known decontamination procedure. The most time consuming steps are the de- and re-fueling of the reactor and the large number of fill and drain steps involved in the two chemical treatments and the several rinses. Nuclear reactors, under normal operating conditions, are very seldom, if ever, drained. They are thus not designed with a view to easy and fast filling and draining. Also, in many reactors, radioactive scale is deposited on fuel sheaths. Customarily the fuel was removed from the reactor prior to surface decontamination rendering it necessary to provide decontamination facilities separate from the main reactor cooling system.

In the selection or development of a suitable decontamination process the following are the most important considerations:

(1) Extent of activity removal or the reduction in radiation fields surrounding the PHTS out-reactor components.

(2) Reactor downtime—due to the high value of electricity produced, by far the largest cost of decontamination is due to the loss in revenue during decontamination.

(3) Waste disposal—radioactive wastes should be in a form that is easy to contain in disposal areas. It is easier to dispose of concentrated solid wastes than large volumes of liquid wastes. The cost of providing storage and concentration facilities for large volumes of liquid wastes can be prohibitive.

To comply with regulations, the resulting radioactive wastes have to be stored and disposed of in a safe manner. Temporary storage requirements for the liquid wastes can be substantial, again due to the large volumes generated in each of the rinses and the two chemical treatments. Waste concentration and disposal facilities must be constructed for the conversion of waste to a solid form.

In making a decision on decontamination, the additional cost associated with high radiation fields are balanced against the cost of decontamination. Additional personnel are required to replace those who reach their regulation dose when high radiation fields exist. The major charges against decontamination are the loss in generation revenue during decontamination shutdown and capital costs for waste storage and treatment facilites. In light of the high costs associated with current decontamination practices, only a few reactors with the highest radiation fields have been decontaminated.

The CAN-DECON process was developed by Atomic Energy of Canada Limited to simplify the decontamination process and substantially reduce its cost, P. J. Pettit, J. E. LeSurf, W. B. Stewart, R. J. Strickert, S. B. Vaughan, "Decontamination of the Douglas Point Reactor by the CAN-DECON Process", presented at CORROSION/78, Houston, Tex., (Mar. 6–10 1978). See also Canadian Patent No. 1,062,590 issued Sept. 18, 1979, S. R. Hatcher, R. E. Hollies, D. H. Charlesworth, P. J. Pettit, "Reactor Decontamination Process". It has been used successfully in the decontamination of nuclear power reactor primary circuits. The principal features of this process are as follows:

small amounts of chemical reagents (typically, to give 0.1 wt% concentration) are injected directly into the coolant of a shutdown nuclear reactor. The contaminated surfaces release to the modified coolant both soluble material and filterable particulate material (crud), a continuous high flow of coolant is passed through the reactor purification system which contains filters and ion exchange resins, filters remove the insoluble matter, cation exchange resin removes dissolved contaminants from the coolant and regenerates the reagents, the regenerated chemicals return to the primary system where they are continuously reapplied to the reactor surfaces, the CAN-DECON process is terminated by using mixed anion and cation resins to remove the chemical reagent and residual dissolved contamination from the reactor systems.

The advantages of CAN-DECON over conventional decontamination are as follows:

It is simple to apply. There is no need to de-fuel the reactor and contaminants from fuel surfaces are also removed. The downtime is short. Corrosion rates on system components are low. Only solid radioactive wastes are produced, simplifying disposal. The combination of the above factors results in a less expensive process. An additional advantage, specific to heavy-water-cooled reactors, is the minimal downgrading of heavy water with $H_2O$ contained by the chemical reagents added.

The CAN-DECON process is effective in decontaminating carbon steel and Monel-400 (trademark) surfaces in both PHWR nuclear reactors and iron-, chromium- and nickel-containing alloy surfaces in BWRs. It is, however, much less effective in decontaminating iron-, chromium-and nickle-containing alloy surfaces which are the major PHTS surfaces in most existing PWRs.

PRESENT INVENTION

It would be desirable to develop a decontamination process for systems including chromium-containing alloys or their equivalent that conforms to these CAN-DECON principles and can be applied economically. A further object of this invention is to extend the principles of the CAN-DECON process to the decontamination of PWRs. A viable alternative to the alkali permanganate oxidation was necessary since this reagent is required in high concentration and is not amenable to complete removal without draining and rinsing the reactor system. The following approaches were considered:

(1) Use an oxidizing agent where both the products of oxidation and the reagent itself are gaseous; thus degassing accomplishes chemical removal. Oxygen is the logical candidate (see Example 4 below).

(2) Utilize hydrogen peroxide. The reaction product is water. While in light-water-cooled reactors there is no need for reaction product ($H_2O$) removal, the reaction product would contribute to isotopic dilution in heavy water systems, unless $D_2O_2$, rather than $H_2O_2$ was utilized. (See Examples 14 and 15 below).

(3) Other chemical oxidants must be applicable at low reagent concentrations to make the removal of the unreacted reagent and reaction products by ion exchangers or adsorbents, feasible. Low concentrations in the vicinity of only about 0.1% are generally required. At higher concentrations the cost of ion exchange resins or adsorbents may be prohibitive.

To the best of my knowledge, no system has been found that conforms to approach (3) above. On thoroughly investigating approaches (1) and (2), neither oxygen nor hydrogen peroxide gave fully satisfactory results. However, it has been found that ozone is a peculiarly effective pretreatment reagent and has unique oxidizing properties not possessed by oxygen or hydrogen peroxide as shown in the test results given below.

Unexpectedly, it was found that ozone gave the desired oxidation and reduction in contamination while oxygen or hydrogen peroxide did not (see Examples 4, 14, and 15 below).

SUMMARY OF THE INVENTION

This invention is a method of decontaminating and removing corrosion products at least some of which are radioactive, from nuclear reactor surfaces exposed to coolant or moderator, said surfaces containing acid-insoluble metal oxides rendered more soluble by oxidation, comprising:

(a) contacting the contaminated surfaces with ozone to an extent sufficient to oxidize insoluble surface metal oxide or oxides, oxides of said metals being thereby rendered more soluble in water or acidic decontaminating solutions;

(b) dissolving solubilized surface metal oxides in an aqueous liquid;

(c) removing the remaining surface oxides into aqueous liquid containing oxide-removing acidic decontaminating reagents;

(d) filtering the resulting aqueous liquids to remove solid particles;

(e) treating the aqueous liquids to remove dissolved metals; and (f) removing both residual dissolved metals and reagents from the reactor system to complete the decontamination.

Steps (b) to (e) are usually applied in a continuous manner during the decontamination. Cation and/or anion exchangers can be used as reagents in steps (c), (e) and (f) for the removal of dissolved species and/or reagents. The loaded filter and exchange resins will normally be disposed of as solid wastes.

It has been found desirable to select the ozone treatment pH conditions from neutral, acidic or basic, for optimum decontamination effect (see Examples below).

Dissolution of chromium oxide from the surface films was identified as the major effect of ozone treatment. While I do not want to be bound by the following theory, I believe that the role of ozone is the oxidation of, e.g. chromium (III) oxide (chromium sesquioxide) to chromium (VI) oxide (chromic acid) followed by the dissolution of the latter in aqueous liquid. With its chromium or equivalent metal content depleted, the remaining surface oxide layer becomes susceptible to attack by acidic decontamination reagents, such as the ones used in the CAN-DECON process.

This ozone pre-treatment conforms to the principles of CAN-DECON decontamination, i.e. it is applied at a low concentration in the primary heat transport system. Also, following treatment, residual dissolved ozone, its reaction product oxygen, and gaseous molecules used as a carrier for ozone such as oxygen or air, can be readily removed from water in the primary heat transport circuit. The process is also suited for the decontamination of the moderator circuit of heavy water moderated reactors.

Test results have shown that selected ozone treatment followed by a second stage decontamination results in significant improvements in Decontamination Factors (DF*) compared to the application of second stage decontamination only, or to $O_2$- or $H_2O_2$-oxidation combined with second stage decontamination.

$$*DF = \frac{\text{Radiation Field Before Decontamination}}{\text{Radiation Field After Decontamination}}$$

DETAILED DESCRIPTION

Figure 1:
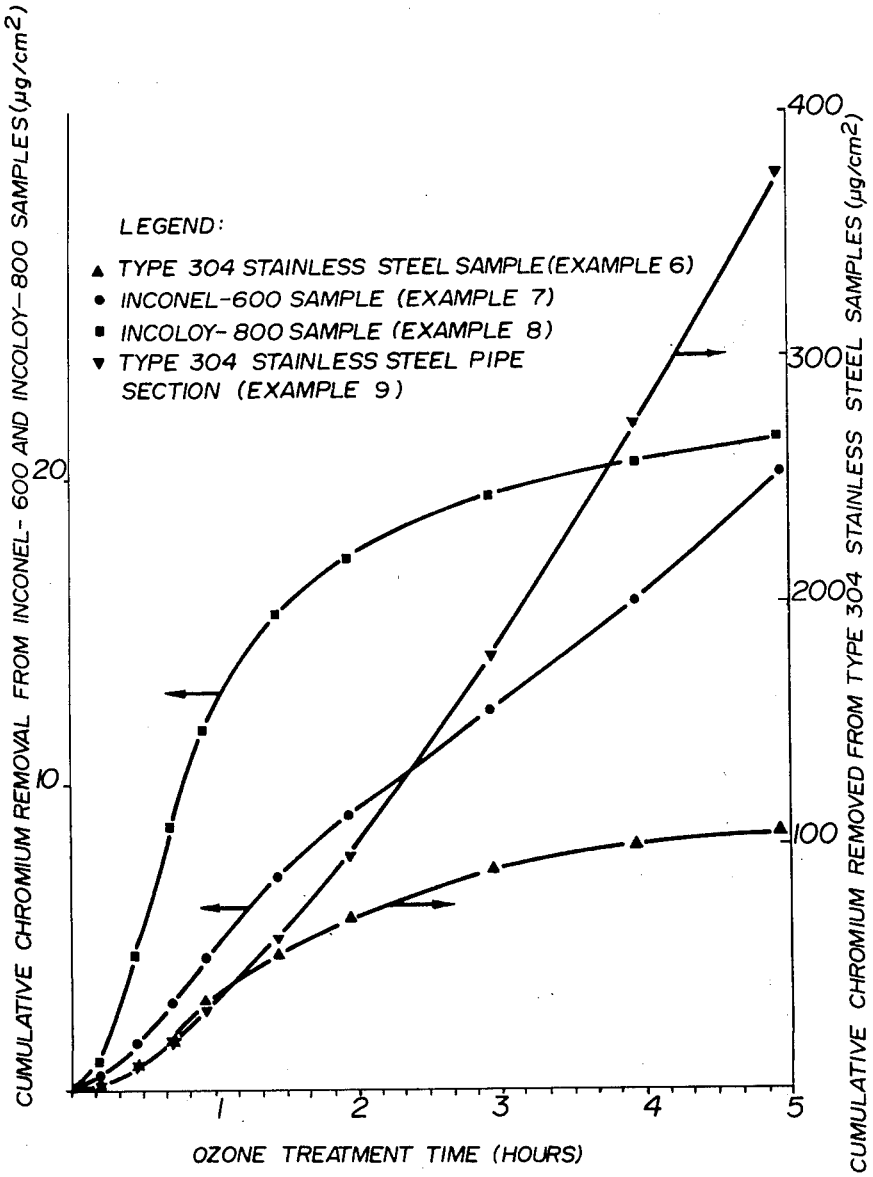
FIG. 1 is a graph showing chromium removal from two typical Cr-alloys and a typical stainless steel, with increasing ozone treatment time.

Several approaches may be used to accomplish the three stages of the decontamination, for example:

(a) oxidation of chromium sesquioxide to chromic acid
(b) dissolution of the chromic acid
(c) dissolution of the remaining surface oxide.

The processes range from three-step operations, where one of the above stages is accomplished per operation, to the alternative, where all of the stages are done in one operation.

Following are some of a variety of ozone oxidation procedures that may be utilized:

(1) Two-phase gas-liquid contacting followed by second stage oxide dissolution, such as the CAN-DECON process.
(2) (a) Gas contacting of surfaces, followed by (b) water washing, followed by (c) CAN-DECON, or equivalent. (a) and (b) may be repeated several times prior to (c).
(3) Contacting surfaces with ozone-saturated water, followed by CAN-DECON, or equivalent.

In each of the above processes, the water used for leaching out the oxidation product chromic acid may also contain acids and complexing agents at low concentration that are capable of dissolving all surface oxide. In this manner, the last two or all three decontamination stages may be combined.

(4) Gas contacting with water mist. Ozone gas is passed through an atomizer, where it picks up water droplets. The coalesced water droplets on the oxide surfaces leach out chromic acid; a CAN-DECON step follows.

In decontamination of the full rector PHTS, dissolved ozone in water is the preferred mode of ozone contacting. The water utilized may be deionized, or it may contain reagents effective in the dissolution of iron and nickel oxides, or other oxides.

The rate of oxidation of chromium is increased with an increase in dissolved ozone concentration. The preferred temperature range for ozone contacting is between the freezing point of the solution and 35° C. The lower temperatures are preferred because they increase the solubility of ozone in water and reduce the rate of the undesirable decomposition of ozone gas.

Another means of increasing the dissolved ozone concentration is to apply a pressure higher than atmospheric in the ozone gas adsorption step and in the heat transport system being decontaminated. Since the primary heat transport system of nuclear reactors is operated at elevated pressures, the pressurization during decontamination can readily be arranged. Elevated pressures up to about 20 atmospheres can be used as long as the temperature does not exceed that causing ozone decomposition. The following optional approaches may be found desirable in some cases to aid chromium oxide removal:

(1) Application of CAN-DECON decontamination first to remove surface oxides with low chromium content, followed by ozone treatment, followed by a second CAN-DECON treatment.
(2) Rapid removal of chromic acid from the solution concurrent with the ozone treatment, or from the water contacting the surfaces following ozone treatment.

In an optional process, the chromic acid dissolved from the surfaces is removed from the circulating water usually before dissolution of the other surface oxide. Various approaches may be utilized to remove chromic acid, such as contacting the solution with anion exchange resin; introduction of a reducing agent to convert the dissolved chromic acid back to chromium sesquioxide followed by filtration; or adsorption of the chromic acid on a suitable adsorbent. Electrochemical chromate (and heavy metal) removal processes may also be used, as known in the art. Optionally the chromic acid removal is continuous as the ozone oxidation proceeds.

In addition to various stainless steels, and various Inconel and Incoloy alloys exemplified, other chromium-containing alloys may be treated with advantage. In PHTS with chromium-containing alloys, the Chromium III oxide may be transported to and incorporated into surface oxide films of chromium-free metals and alloys. Ozone treatment of these oxides would also be of advantage.

Some metal oxides are less susceptible to dissolution by acidic decontamination agents in the metals' lower valence, than in their higher valence state. Oxides of copper and cobalt are among this group and metal surfaces containing these will benefit from ozone treatment.

The completion or sufficiency of the ozone treatment can be monitored by the chromium removal from the surfaces. When chromium removal rates drop to a low level or cease, the ozone treatment step is completed. Chromium removal can be monitored by atomic absorption spectrometer readings on samples of the aqueous liquid.

In FIG. 1, chromium removal rates from Type 304 stainless steel samples and Incoloy-800 samples were low at the end of the five hour ozone treatment period. Following the subsequent second stage decontamination, high decontamination factors were obtained (see Table 2). In contrast the chromium removal rates from the Type 304 stainless steel pipe sections and Inconel-600 samples were high at the termination of the five hour ozone treatment period. Following the second stage decontamination, the decontamination factors were only moderately high (see Table 2).

EXAMPLES SPECIMEN PREPARATION A

Specimens of 1010 carbon steel, type 304 stainless steel, inconel-600 (Trademark of International Nickel Company) and Incoloy800 (Trademark of International Nickel Company) used in Examples 1 to 4 were treated prior to decontamination in the following manner: Several samples of 3×1.5×0.16 cm were:

(1) cut from sheet metal,
(2) pickled with acid to remove scale,
(3) pre-filmed in an autoclave at 350° C. in lithium hydroxide solution at a pH of 10.2 (measured at room temperature) for a period of 7 days,
(4) placed in the primary heat transport system of a research reactor for a period of 12 weeks at 250° C.

The samples were loaded close to the inlet to the reactor in the out-reactor piping.

Following are the ranges of analytical results on the PHTS water:

pH—9.8 to 10.8 adjusted with lithium hydroxide dissolved hydrogen }3.2 to 20.8 mL (at standard temperature and pressure)/kg water The above coolant contained both activated corrosion and fission products that were incorported into the surface oxide layer.

Samples were also obtained of 1¼ in. diameter type 304 stainless steel pipe subject to long term (several years) exposure to PHTS coolant with water chemistry typical to PWR primary heat transport system conditions.

The quantity of radioactive nuclei on the samples was estimated from the output of a multichannel gamma ray spectrometer.

EXAMPLE 1

Ozone Treatment

The following samples were mounted on a stainless steel holder:

(a) 3 of type 304 stainless steel long exposure pipe sections,
(b) 3 of type 304 stainless steel short exposure samples,
(c) 3 of No. 1010 carbon steel samples,
(d) 1 of Incoloy-800 sample, Items (b), (c) and (d) were prepared as outlined in Specimen Preparation A. The samples were placed in a glass container equipped with a gas dispersion bottom. The container was then filled with de-ionized water and oxygen containing 3.5 vol% ozone was bubbled through it. The equipment was maintained at 60° C. for the duration of the five-hour ozone treatment.

Gamma ray spectra of the samples were obtained and the decontamination factor for first stage decontamination was calculated. The results are recorded in Table 1.

The second stage decontamination of samples is described in Example 5.

EXAMPLE 2

Example 1 was repeated except that 0.035% citric acid solution (pH=3.1) rather than distilled water was used for ozone treatment, and 1010 carbon steel samples were excluded. Results are listed in Table 1.

EXAMPLE 3

Example 1 was repeated except that de-ionized water adjusted to pH 10.5 with lithium hydroxide rather than distilled water was used for ozone treatment and 1010 carbon steel samples were excluded. Results are listed in Table 1.

EXAMPLE 4

Example 1 was repeated except that only oxygen, rather than 3.5% ozone-in-oxygen was used in the first stage decontamination. Results are listed in Table 1.

EXAMPLE 5

The equipment utilized for the second stage decontamination was basically a circuit including a pump, first flowmeter and test section. Constructed of type 304 stainless steel and glass, the circuit consisted of a major circulating loop with a glass test section housing the samples being decontaminated. A side stream contained a second flowmeter, a cooler and ion exchange column used in reagent regeneration.

The long-exposure samples to type 304 stainless steel pipe sections from Examples 1 to 3, together with 3 samples of the same material not subjected to Stage 1 (ozone) decontamination, were mounted in the glass test section. Similarly 1010 carbon steel samples, short-exposure type 304 stainless steel samples, and Incoloy-800 samples were subjected to second stage decontamination in separate experiments. The ion exchange column was filled with 100 mL of IRN-77 (Trademark of Rohm and Haas) hydrogen-form cation exchange resin. The equipment was then filled with 1200 mL de-ionized water, the circulating pump was started, and the water heated up to 125° C.; 1.2 g of LND-101 (Trademark of London Nuclear Decontamination Ltd.) decontamination reagent (which contained organic acids and complexing agents) was added. The flow rate in the main circuit (flowmeter I) was maintained at 6 L/minute and in the purification circuit at 0.08 L/minute (flowmeter II). The side stream was cooled to 70° C. Decontamination time computed from chemical addition was four hours. The equipment was cooled down, drained and the samples were removed for analysis with a gamma ray spectrometer. Decontamination factors for second stage decontamination and overall decontamination are listed in Table 1.

The following examples will illustrate that ozone removes chromium from the surface oxide and that the rate of removal is dependent upon the type of alloy treated and the thickness of the surface oxide.

SPECIMEN PREPARATION B

Samples used in Examples 6, 7 and 8 were treated as in Specimen Preparation A except that they were not prefilmed in an autoclave (Step 3).

EXAMPLE 6

Three samples of type 304 stainless steel, treated as outlined in B above, were suspended in a glass container. During a five-hour period distilled water was pumped through at 4.2 mL/min and oxygen containing 2.9 vol% ozone was bubbled into the container. The contactor was kept at 25° C. Effluent water samples were taken and analyzed for chrominum content. Cumulative chromium removal from a unit metal surface area is plotted in FIG. 1. The ozone treatment is seen to be very effective in increasing chromium removal (and thus overall decontamination).

EXAMPLE 7

Example 6 was repeated except that Inconnel-600, pretreated as outlined at B above, rather than type 304 stainless steel, samples were treated.

EXAMPLE 8

Example 6 was repeated that Incoloy-800, pretreated as outlined at B above, rather than type 304 stainless steel, samples were treated.

EXAMPLE 9

Example 6 was repeated except that sections of 1.25 inch diameter type 304 stainless steel pipe test sections were treated. The pipe was subjected to long term (several years) exposure to PHTS coolant with water chemistry typical of a PHWR heat transport system. The pipe sections were convered with a dark layer of surface oxide.

EXAMPLE 10

Samples treated with ozone, in Examples 6–9, along with control samples without ozone treatment, were subjected to second stage decontamination described in Example 5. Decontamination conditions were the same, except the temperature was 85° C. rather than 125° C. Decontamination factors obtained for cobalt-60 are summarized in Table 2.

Samples were weighed before ozone treatment and after decontamination. Average weight loss for type 304 stainless steel samples and Inconel-600 samples are compared with the calculated $Cr_2O_3$ removal during ozone treatment and the chrominum content of the alloy in Table 3.

EXAMPLE 11

The chromium removal rate from type 304 stainless steel pipe sections was high at the end of the 5-hour ozone treatment period (Example 9, FIG. 1). Improvements in decontamination factor due to ozone treatment were small—see Example 10 and Table 2. These results suggested that chromium removal from the surface oxide was incomplete.

Two of the three samples treated in Examples 9 and 10 were subjected to ozone treatment again, as described in Example 9 for two consecutive 5-hour periods. Following decontamination, as described in Example 10 the average overall decontamination factor (for 3 ozone treatments and 2 CAN-DECON decontaminations) was 7.5 for cobalt-60.

EXAMPLE 12

Cyclic treatment with ozone gas followed by water wash

Two Incoloy-800 samples were pre-treated as in Specimen Preparation A. They were then exposed to a stream of oxygen, saturated with water and containing 2.9 vol% ozone, at 25° C. for a 90-minute period. To remove the oxidized chromium the samples were washed with deionized water for 1 hour at 25° C. The above ozone contacting followed by water wash cycle was repeated. Samples of effluent water were taken for chromium analysis. Cumulative chromium removal for unit sample surface area is plotted as a function of water washing time in FIG. 2. The samples were then subjected to the second stage decontamination along with control samples not subjected to ozone treatment. The procedure outlined in Example 10 was followed. An average overall decontamination factor for cobalt-60 of 2.9 was obtained, compared with an average decontamination factor of 1.2 for the control sample.

EXAMPLE 13

Treatment with ozone dissolved in deionized water

Figure 2:
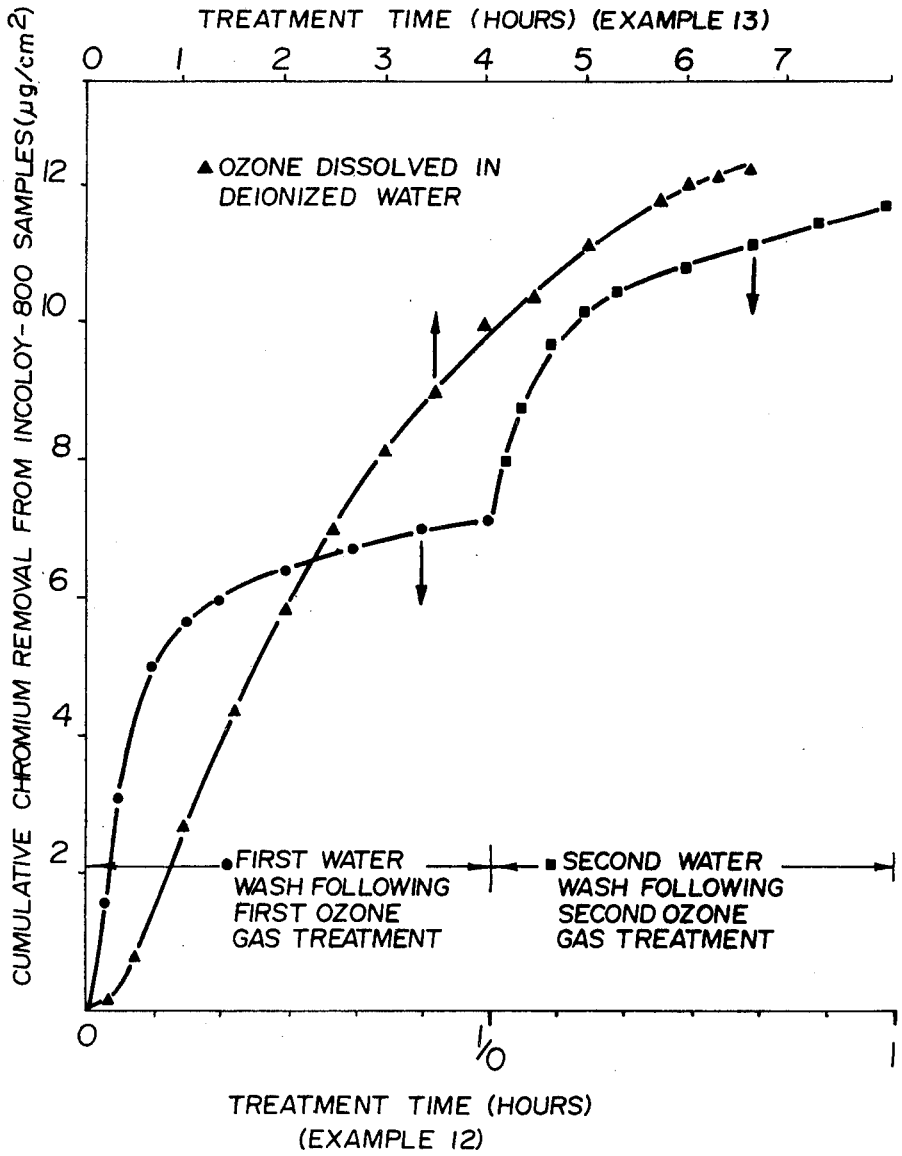
FIG. 2 is a graph showing chromium removal vs. ozone treatment time for two different ozone treatments.

Deionized water was contacted with oxygen containing 2.9 vol% ozone. The ozone-saturated water, $1.93\times10^{-4}$ molar in ozone, was pumped through a contacting container, housing four Incoloy-800 samples pretreated according to the procedure in Specimen Preparation A. During the 400-minute ozone treatment at 25° C. the effluent water samples were analysed for chromium content. Cumulative chromium removal for a unit surface area of the sample is illustrated in FIG. 2.

The samples were then subject to the second stage decontamination along with three control samples that were not subjected to ozone treatment. An average overall decontamination factor for cobalt-60 of 5.8 was obtained, compared with an average decontamination factor of 1.3 for the control samples.

EXAMPLE 14

This experiment was performed to assess the effectiveness of hydrogen peroxide as a first stage pretreatment reagent. The treatment procedure was identical with the one specified in U.S. Pat. No. 3,873,362.

Six Incoloy-800 samples were pretreated as in Specimen Preparation A. Three of these samples were suspended in a beaker containing a 2% hydrogen peroxide solution, heated to 52° C., and kept between 49° and 57° C. for a period of 5 hours. All six samples were then subjected to the second stage decontamination as outlined in Example 10. The average decontamination factor for the hydrogen peroxide treated samples, and also for the samples not subjected to first stage treatment, was 1.3.

EXAMPLE 15

Example 14 was repeated except that type 304 stainless steel samples were used. The pretreatment procedure in Specimen Preparation B was utilized. The average decontamination factor for the hydrogen peroxide treated samples, and also for the samples not subjected to pretreatment, was 1.1.

From these Examples 14 and 15 it is seen that pretreatment with hydrogen peroxide was no more effective than the basic second stage decontamination alone or iron-, chromium- and nickel-containing alloy surfaces and on stainless steel surfaces.

EXAMPLE 16

Corrosion Rate Assessment (a) Of the common materials of construction of the heat transport and moderator systems of nuclear reactors, carbon steel is the most susceptible for general corrosion. Accordingly, the corrosion rate of carbon steel during ozone treatment was evaluated.

Sample Preparation:

Several samples, 3×1.5×0.16 cm, of 1010 carbon steel were:

1. cut from sheet metal,
2. pickled with acid to remove scale,
3. divided into two sets; half of the samples were prefilmed in an autoclave at 350° C. in lithium hydroxide solution at a pH of 10.2 (measured at room temperature) for a period of 7 days.

(b) Six pickled and prefilmed and six pickled samples were weighed. Three each of these samples were placed in a 100 mL volume glass container. Citric acid solution (0.03%) adjusted to pH 5 by the addition of lithium hydroxide solution was pumped through the cell at 30 mL/min. Oxygen gas containing 2.5 vol% ozone was bubbled into the same container at a rate of 1.15 L/min. The contact cell was kept at 25° C. The samples were exposed for a 4-hour period. Surface oxide layers on the above samples along with control samples not exposed to ozone treatment were chemically removed; the samples were weighed and the weight losses calculated. Corrosion due to ozone treatment was calculated from the difference in weight loss between the ozone treated and control samples. The average total corrosion in μm and corrosion rate in μm/h is revealed in Table 4.

EXAMPLE 17

Example 16(b) was repeated except that deionized water was passed through the glass container, with the result given in Table 4.

It is believed that this is the first method that can successfully decontaminate chromium-containing alloys in the PHTS of PWRs and PHWRs whereby:

1. The first stage reagent is present in the system at a low concentration—in the range of parts per million.
2. The PHTS does not have to be drained at any stage of the decontamination.
3. Products of the decontamination, such as dissolved scale, oxygen, etc., and unreacted chemicals can easily and quantitatively be removed in both first and second stage decontamination.
4. When applied to systems filled with heavy water coolant, the treatment results in negligible isotopic dilution of heavy water.
5. The anticipated reactor downtime is shorter than in conventional decontamination.
6. Only solid radioactive wastes are produced, simplifying waste disposal.

Summarizing the examples, oxidants that would incorporate the CAN-DECON advantages such as oxygen and hydrogen peroxide have been assessed and were found ineffective as pretreatment reagents. Results of examples 4 and 5 listed in Table 1 illustrate decontamination factors for samples treated with oxygen first, followed by second stage decontamination. The overall decontamination factors were approximately the same as when second stage decontamination only was performed. Similarly, hydrogen peroxide pretreatment was no more effective than the basic second stage decontamination alone (see examples 14 and 15). Unpredictably, ozone was found to be very effective. On chromium-containing alloys the overall decontamination factors for Co-60 ranged from 1.1 to 1.4, when second stage decontamination only was performed. Ozone pretreatment, followed by second stage decontamination resulted in a dramatic increase in decontamination factor. D.F.'s of up to 40.6 were obtained (see examples 2 and 5 and Table 1). As may be seen from FIGS. 1 and 2, high D.F.'s can be obtained by near complete oxidation of chromium sesquioxide to chromic acid and the subsequent leaching out of the latter acid; followed by the second stage decontamination.

TABLE 1

AVERAGE DECONTAMINATION FACTORS

| Description | Example # | Specific Nuclei: Co-60 1-2 | Co-60 2-3 | Co-60 1-3 | Fe-59 1-2 | Fe-59 2-3 | Fe-59 1-3 | Zr-95 1-2 | Zr-95 2-3 | Zr-95 1-3 | Nb-95 1-2 | Nb-95 2-3 | Nb-95 1-3 | Ru-103 1-2 | Ru-103 2-3 | Ru-103 1-3 | No. of Samples |
|---|---|---|---|---|---|---|---|---|---|---|---|---|---|---|---|---|---|
| 304 stainless steel pipe sections (long exposure) | | | | | | | | | | | | | | | | | |
| 2nd stage decontam. only | 5 | | 1.4 | 1.4 | | | | | | | | | | | | | 3 |
| Oxygen in DI water | 4 & 5 | 1.1 | 1.3 | 1.4 | | | | | | | | | | | | | 3 |
| Ozone in DI water | 1 & 5 | 2.4 | 4.4 | 10.7 | | | | | | | | | | | | | 3 |
| Ozone in acid | 2 & 5 | 1.2 | 3.7 | 4.7 | | | | | | | | | | | | | 3 |
| Ozone in base | 3 & 5 | 1.0 | 3.1 | 3.1 | | | | | | | | | | | | | 3 |
| 3.4 stainless steel (short exposure) | | | | | | | | | | | | | | | | | |
| 2nd stage decontam. only | 5 | | 1.2 | 1.2 | | 1.5 | 1.5 | | | 2.7 | | | 1.2 | | | 2.0 | 2 |
| Oxygen in DI water | 4 & 5 | 1.0 | 1.3 | 1.3 | 1.1 | 1.5 | 1.7 | 1.9 | 1.3 | 2.3 | 0.8 | 1.1 | 0.9 | 1.0 | 7.3 | 7.4 | 3 |
| Ozone in DI water | 1 & 5 | 1.1 | 2.1 | 2.3 | 1.0 | 2.6 | 2.5 | 1.6 | 1.6 | 2.6 | 1.0 | 1.4 | 1.4 | 1.1 | 3.9 | 4.1 | 3 |
| Ozone in acid | 2 & 5 | 1.0 | 1.3 | 1.3 | 1.0 | 1.5 | 1.5 | 1.6 | 1.6 | 2.5 | 1.0 | 1.4 | 1.3 | 1.1 | | | 3 |
| Ozone in base | 3 & 5 | 1.0 | 1.3 | 1.3 | 1.0 | 1.5 | 1.5 | 2.2 | 1.4 | 3.1 | 1.2 | 1.3 | 1.6 | 1.1 | | | 3 |
| Incoloy-800 | | | | | | | | | | | | | | | | | |
| 2nd stage decontam. only | 5 | | 1.3 | 1.3 | | 4.0 | 4.0 | | 1.4 | 1.4 | | | | | 9.9 | 9.9 | 1 |
| Oxygen in DI water | 4 & 5 | 1.0 | 1.4 | 1.3 | 0.9 | 5.2 | 4.8 | 1.2 | 1.3 | 1.6 | | 1.2 | | 1.0 | | | 1 |
| Ozone in DI water | 1 & 5 | 1.6 | 2.3 | 3.7 | 0.9 | ∞ | ∞** | 1.4 | 2.7 | 3.9 | | 2.0 | | 1.2 | 3.0 | 3.6 | 1 |
| Ozone in acid | 2 & 5 | 1.0 | 40.6 | 40.6 | 1.0 | ∞ | ∞** | 1.6 | 1.8 | 2.8 | | 1.5 | | 1.3 | 29.6 | 37.8 | 1 |
| Ozone in base | 3 & 5 | 1.0 | 19.0 | 18.5 | 1.0 | ∞ | ∞** | 1.2 | 1.6 | 1.9 | | 1.4 | | 1.2 | 1.9 | 2.3 | 1 |

TABLE 1-continued

| Description | Example # | Co-60 1-2 | Co-60 2-3 | Co-60 1-3 | Fe-59 1-2 | Fe-59 2-3 | Fe-59 1-3 | Zr-95 1-2 | Zr-95 2-3 | Zr-95 1-3 | Nb-95 1-2 | Nb-95 2-3 | Nb-95 1-3 | Ru-103 1-2 | Ru-103 2-3 | Ru-103 1-3 | No. of Samples |
|---|---|---|---|---|---|---|---|---|---|---|---|---|---|---|---|---|---|
| | | AVERAGE DECONTAMINATION FACTORS — Specific Nuclei | | | | | | | | | | | | | | | |
| 1010 Carbon Steel | | | | | | | | | | | | | | | | | |
| Oxygen in DI water | 4 & 5 | 1.0 | 30.7 | 30.1 | 1.0 | 19.1 | 19.1 | 1.8 | 7.4 | 13.1 | 1.0 | 7.0 | 6.8 | 1.0 | 24.7 | 23.9 | 3 |
| Ozone in DI water | 1 & 5 | 0.8 | 19.6 | 15.9 | 1.0 | 12.1 | 12.0 | 1.9 | 4.4 | 8.0 | 1.1 | 3.8 | 4.1 | 1.0 | 2.0 | 2.1 | 3 |

Notes:
*1-2, 1st stage; 2-3, 2nd stage; 1-3, overall.
**Specific activity for Fe-59 for after-second decontamination samples was below detectable limit. DF assumed to be infinity.

TABLE 2

AVERAGE Co-60 DECONTAMINATION FACTORS

| Examples | Materials | CAN-DECON Only | Ozone + CAN-DECON |
|---|---|---|---|
| 6, 10 | 304 stainless steel | 1.1 | 15.0 |
| 7, 10 | Inconel-600 | 1.1 | 2.7 |
| 8, 10 | Incoloy-800 | 1.1 | 9.3 |
| 9, 10 | 304 stainless steel pipe sections | 1.9 | 2.5 |

TABLE 3

WEIGHT LOSS OF SAMPLES DURING DECONTAMINATION AND $Cr_2O_3$ REMOVAL BY TWO PHASE OZONE TREATMENT (based on 3 samples of each material)

| Examples | Material | (A) Weight Loss ($g/cm^3$) $\times 10^6$ | (B) $Cr_2O_3$ loss ($g/cm^3$) $\times 10^6$ | (100 B/A) % of oxide removed as $Cr_2O_3$ | % chromium in alloy |
|---|---|---|---|---|---|
| 6, 10 | 304 SS | 339 | 105 | 31 | 20 |
| 7, 10 | Inconel-600 | 38.7 | 20.2 | 52.2 | 16 |

TABLE 4

CORROSION OF CARBON STEEL SAMPLES IN OZONE-SATURATED SOLUTIONS

| Example | Solution | Ozone Conc. % | Total Corrosion (μm) Pre-filmed | Total Corrosion (μm) Pickled | Corrosion rate (μm/h) Pre-filmed | Corrosion rate (μm/h) Pickled |
|---|---|---|---|---|---|---|
| 16(b) | 0.03% citric acid adjusted to pH 5 with LiOH | 2.5 | 0.076 | 2.55 | 0.019 | 0.64 |
| 17 | deionized water | 2.3 | 0.013 | 0.0 | 0.003 | 0.0 |

I claim:

1. A method of decontaminating and removing corrosion products at least some of which are radioactive, from nuclear reactor surfaces exposed to coolant or moderator, said surfaces containing acid-insoluble metal oxides, including chromium oxide, rendered more soluble by oxidation, comprising:

(a) contacting the contaminated surfaces with ozone to an extent sufficient to oxidize insoluble surface metal oxide or oxides, oxides of said metals being thereby rendered more soluble in water or acidic decontaminating solutions;

(b) dissolving the solubilized surface metal oxides in an aqueous liquid;

(c) dissolving or detaching the remaining surface oxides into aqueous liquid containing oxide-removing acidic decontaminating reagents;

(d) removing insoluble particulate material from the resulting aqueous liquids;

(e) removing dissolved metals from the resulting aqueous liquids; and (f) removing both residual dissolved metals and reagents from the reactor system to complete the decontamination.

2. The method of claim 1 wherein the insoluble metal oxide is chromium (III) oxide.

3. The method of claim 1 wherein the contaminated surfaces include iron-, chromium-, and nickel-containing alloy.

4. The method of claim 1 wherein ozone-saturated water is used in step (a).

5. The method of claim 1 wherein a two-phase gas-liquid mixture is used to transport ozone into contact with the surfaces in step (a).

6. The method of claim 1 wherein an ozone-containing gas or gas-water mist is used in step (a).

7. The method of claim 1 wherein the completion or sufficiency of the ozone treatment in step (a) is monitored by following the chromium removal rate from the surfaces.

8. The method of claim 1 wherein water is present during step (a) and the aqueous pH is adjusted to give maximum decontamination.

9. The method of claim 1 wherein the liquid coolant or moderator is heavy water.

10. The method of claim 9 wherein the heavy water is used as carrier for ozone, and for decontaminating reagents.

11. The method of claim 1 wherein relatively non-corrosive decontaminating reagents in low concentrations of the order of about 0.1% wt. are used in steps (c) or (b) plus (c) to minimize corrosion and facilitate reagent removal in (f).

12. The method of claim 1 wherein cation- and anion-exchange resins are contacted in step (f) for dissolved metal and reagent removal thereon.

13. The method of claim 12 wherein the ion exchange resins are initially in the $H^+$ and $OH^-$ form.

14. The method of claim 12 wherein heavy water is the aqueous liquid and the ion exchange resins are initially in the $D^+$ and $OD^-$ form.

15. The method of claim 1 including the step of recycling the treated aqueous liquid from step (e) to step (b) or (c).

16. The method of claim 2 wherein upon ozone oxidation chromic acid dissolves, and this chromic acid is removed by cycling the Cr-containing water through a chromium removal zone.

17. The method of claim 1 wherein before step (a) an initial decontamination with acidic decontaminating reagents is carried out.

18. The method of claim 1 wherein oxygen is utilized with the ozone in step (a).

19. The method of claim 1 wherein the temperature during the oxone contacting in step (a) is below about 35° C.

* * * * *